US008111498B2

(12) United States Patent
Ben-Yaakov

(10) Patent No.: US 8,111,498 B2
(45) Date of Patent: Feb. 7, 2012

(54) ELECTRONIC CIRCUITRY FOR INCAPACITATING A LIVING TARGET

(75) Inventor: Shmuel Ben-Yaakov, Beer Sheva (IL)

(73) Assignee: SDI - Security Device International Inc., Bney Braq (IL)

( * ) Notice: Subject to any disclaimer, the term of this patent is extended or adjusted under 35 U.S.C. 154(b) by 881 days.

(21) Appl. No.: 12/169,729

(22) Filed: Jul. 9, 2008

(65) Prior Publication Data

US 2010/0008012 A1 Jan. 14, 2010

(51) Int. Cl.
*H01T 23/00* (2006.01)

(52) U.S. Cl. ..... 361/232

(58) Field of Classification Search ..... 361/232
See application file for complete search history.

(56) References Cited

U.S. PATENT DOCUMENTS 3,803,463 A * 4/1974 Cover ..... 361/232
7,110,897 B2 * 9/2006 Nadig et al. ..... 702/66
7,218,501 B2 * 5/2007 Keely ..... 361/232
7,237,352 B2 * 7/2007 Keely et al. ..... 42/1.08
7,778,005 B2 * 8/2010 Saliga ..... 361/232
2008/0297970 A1 * 12/2008 Rutz et al. ..... 361/232
2011/0063770 A1 * 3/2011 Brundula et al. ..... 361/232

* cited by examiner

*Primary Examiner* — Ronald W Leja
(74) *Attorney, Agent, or Firm* — The Law Office of Michael E. Kondoudis

(57) ABSTRACT

An electronic circuit which provides an electrical incapacitation current to a living target. The circuit includes a high voltage power supply, a charge-storing capacitor connected by a high voltage lead to the high voltage power supply. The charge-storing capacitor stores a charge at high voltage as supplied by the high voltage power supply. The circuit further includes a switch, a step-up transformer including a primary coil a secondary coil, a resonant circuit and an output terminal serially connected through the secondary coil to the high voltage lead of the charge-storing capacitor. The primary coil is connected in parallel with the charge-storing capacitor through the switch. During the incapacitation, the output terminal is operatively attached to at least a part of the living target. When the switch is closed, the resonant circuit initially stores zero charge, and any gap if present between the output terminal and the living target undergoes electrical breakdown from energy stored in the charge-storing capacitor. After the electrical breakdown, the incapacitation current is provided substantially from the charge stored in the charge-storing capacitor.

18 Claims, 13 Drawing Sheets

ELECTRONIC CIRCUITRY FOR INCAPACITATING A LIVING TARGET

FIELD AND BACKGROUND

The present invention relates to a non-lethal weapon. More particularly, the present invention relates to circuitry which generates voltages and currents sufficient for incapacitation or immobilization of a target. The circuitry may be implemented in a projectile launched from a standard weapon.

Non-lethal weapons intend to temporarily disable a living target, i.e. a person or animal without causing permanent damage. Among possible methods for incapacitation, electrical current is considered relatively safe and practical to implement. In this approach, a pulsating current is injected across a portion of the body tissue of the target. The shape and magnitude of the current are such that the current interferes with the neuromuscular system of the target, and causes a temporary disabling or stun effect. In order to prevent possible interaction between the persons, e.g. who control the non-lethal weapon, and the target, remote operation of the non-lethal weapon is desirable. The electrical incapacitation preferably takes place while the controlling agent is at a distance from the subject. Non-lethal immobilization weapons have been developed with tethers or wires attached between the power source and the projectile.

Electrical pulses used for incapacitation preferably include a high voltage component. High voltage is required to breakdown any gaps in the electrical circuit path that carries the incapacitation signal from the weapon to the target. The presence of the gaps stems from the fact that the electrodes connected to the circuitry may not reach the body tissue of the target due to clothing and/or other obstacles. An electrical breakdown in the gaps generates electrically conducting plasmas which close the electrical circuit between the weapon and the target. Once the electrical breakdown occurs, the electrical circuit conducts from the weapon to the target without galvanic contact between the electrodes and the body tissue. Circuits which first breakdown non-conducting gaps by a high voltage and ionize the gas allowing a current to flow through the gap, are well known dating for instance to early designs of fluorescent lamp ballasts. (See for instance W. Elenbass, Ed. Fluorescent Lamp. UK. London, Macmillan, 1971.) Similar circuits are also used for starting high intensity discharge (HID) lamps such as a sodium HID lamp (e.g. S. Ben-Yaakov, and M. Gulko., Design and performance of an electronic ballast for high pressure sodium (HPS) lamps. IEEE Trans. Industrial Electronics, 44, 4, 486-491, 1997).

U.S. Pat. No. 6,999,295 discloses an electronic disabling device for immobilizing a target including a power supply, first and second energy storage capacitors, and two switches to selectively connect the two energy storage capacitors to down stream circuit elements. Reference is now made to FIG. 1 which is a schematic circuit drawing according to the teachings of U.S. Pat. No. 6,999,295. Two power supplies PS1, PS2 charge two capacitors C11, C12 to respective specified voltages in order to store the energies needed for: (1) generating the high voltage required for breaking down gaps GAP1, GAP2 and (2) to deliver the incapacitating current to the target represented as an electrical load $Z_L$. Capacitor C12 which stores the energy required for (1) generating the high voltage, is connected, via a spark gap SPK2, to the primary n1 of transformer T1 having a secondary high voltage winding n2. Capacitor, C11, storing the energy to (2) deliver the incapacitation current is connected to secondary n2, of transformer T1, via a spark gap SPK1. Both spark gaps SPK1 and SPK2 are initially in the 'off' non conducting state. Pulse generation commences when the voltage across C12 reaches the breakdown voltage of SPK2. On breakdown across SPK2, a resonant circuit is closed including capacitor C12 and the inductance of primary n1 of transformer T1. The resonant circuit according to the teachings of U.S. Pat. No. 6,999,295 hence has finite initial energy from the charge stored in capacitor C12. A conduction path which is now enabled by the breakdown across SPK2 builds up a sinusoidal current causing a sinusoidal voltage to appear across the primary of n1. Transformer T1 is built as a step up transformer (n2>n1), and consequently a high voltage appears across secondary n2 of transformer T1 which breaks down gaps GAP1 and GAP2 and spark gap SPK1 along the circuit path. Breakdown in spark gap SPK1, and gaps GAP1 and GAP2 open a conduction path between the voltage across C11 and the target load $Z_L$.

BRIEF SUMMARY

According to an aspect of the present invention, there is provided an electronic circuit which provides an electrical incapacitation current to a living target. The circuit includes a high voltage power supply, a charge-storing capacitor connected by a high voltage lead to the high voltage power supply. The charge-storing capacitor stores a charge at high voltage as supplied by the high voltage power supply. The circuit further includes a switch, a step-up transformer including a primary coil, a secondary coil, a resonant capacitor connected in parallel with the charge-storing capacitor through the primary coil, and an output terminal operatively connected through the secondary coil (optionally through the switch) to the high voltage lead of the charge-storing capacitor. The primary coil is connected in parallel with the charge-storing capacitor through the switch. During the incapacitation, the output terminal is operatively attached to at least a part of the living target. When the switch is closed, any gap if present between the output terminal and the living target undergoes electrical breakdown from energy stored in the charge-storing capacitor. After the electrical breakdown, the incapacitation current is provided substantially from the charge stored in the charge-storing capacitor. When the switch is closed an electrical resonance starts in a resonance path preferably including the primary coil, the resonant capacitor and the charge-storing capacitor through the switch. Voltage peaks of the resonance as induced in the secondary coil contribute to the electrical breakdown. A spark gap is operatively connected serially with the output terminal, the spark gap undergoes electrical breakdown from the energy stored in the charge-storing capacitor so that the spark gap provides an electrical breakdown step even when a gap between the output terminal and the living target is not present. The switch is preferably closed when the charge-storing capacitor is charged to a predetermined level. The switch preferably includes a spark gap which breaks down at a predetermined voltage. Alternatively, the switch is controlled by a timer previously set to close the switch at a predetermined rate (in pulses per second). The charge storing capacitor is charged so that the desired level of predetermined voltage is reached on or before closure of the switch. The high voltage power supply preferably includes: a battery, a tapped inductor with a first lead connected to the battery and a second lead operatively connected to the high voltage lead of the charge-storing capacitor; and a boost converter connected to a tapped lead of the tapped inductor with a high voltage output operatively connected to the charge-storing capacitor. The electronic circuit optionally includes a secondary coil of the transformer and a second output terminal attached to at least a part of the living target. The second secondary coil electrical connects the second output terminal to the low voltage lead of the charge-storing capacitor.

According to another aspect of the present invention, there is provided an electronic circuit which provides one or more electrical incapacitation pulses to a living target. The circuit includes a high voltage power supply, charge-storing capacitor connected by a high voltage lead to the high voltage power supply. The charge-storing capacitor stores a charge at high voltage as supplied by the high voltage power supply. The circuit further includes a switch, a step-up transformer including a primary coil and a secondary coil and a resonant capacitor. The primary coil and the resonant capacitor are connected in parallel with the charge-storing capacitor through said switch. An output terminal is series connected through the secondary coil to the high voltage lead of the charge-storing capacitor. During the incapacitation, the output terminal is operatively attached to at least a part of the living target. The circuit includes a control mechanism for actively controlling the incapacitation pulses. The control mechanism preferably includes a sense resistor operatively connected in series with the living target and an operational amplifier with an input connected to the sense resistor and an output operatively connected to the living target. The sense resistor and the operational amplifier provide active control of the incapacitation current of the incapacitation pulses in a closed loop. Alternatively, a sense resistor is operatively connected in series with the living target; and a control circuit, e.g. microprocessor, with an input from the sense resistor, the input being proportional to the incapacitation current of the incapacitation pulses. A sense capacitor is preferably connected in series with the living target. A control circuit preferably includes an input from the sense capacitor proportional to the charge of the incapacitation pulses delivered to the living target.

According to yet another aspect of the present invention there is provided a method for electrical incapacitation to a living target. A circuit is provided including a high voltage power supply, a charge-storing capacitor connected by a high voltage lead to the high voltage power supply, the charge-storing capacitor storing a charge at high voltage as supplied by the high voltage power supply, a switch, a step-up transformer including a primary coil and a secondary coil. A resonant circuit including the primary coil is connected in parallel with the charge-storing capacitor through the switch. An output terminal is series connected through the secondary coil to the high voltage lead of the charge-storing capacitor. The output terminal is attached to at least a part of the living target. The charge-storing capacitor is charged to a predetermined level. The switch is closed when the charge-storing capacitor is charged to the predetermined level and a gap if present between the output terminal and the living target is electrically broken down from energy stored in the charge storing capacitor. The living target is incapacitated from the charge stored in the charge-storing capacitor. Upon the closing the switch, an electrical resonance starts in the resonant circuit. Resonance peaks induced in the secondary coil contribute to the electrical breakdown. Just prior to closing the switch the resonant circuit preferably stores substantially zero energy. Upon closing the switch, an electrical resonance preferably starts in the resonant circuit including the primary coil, a resonant capacitor and the charge-storing capacitor through the switch. Resonance peaks are induced in the secondary coil which contribute to the electrical breakdown. The resonant capacitor is preferably connected in parallel with the charge-storing capacitor through the primary coil. The incapacitation current is preferably provided in a series of pulses. A residual voltage is preferably measured on the charge-storing capacitor. Based on the residual voltage, the predetermined level is adjusted for at least one subsequent pulse.

According to an embodiment of the present invention there is provided an electronic circuit which provides an electrical incapacitation current to a living target. The circuit includes a high voltage power supply, a charge-storing capacitor connected by a high voltage lead to the high voltage power supply. The charge-storing capacitor stores a charge at high voltage as supplied by the high voltage power supply. The circuit further includes a resonant circuit, a switch connecting the resonant circuit to the charge storing capacitor, a step-up transformer including a primary coil and a secondary coil. The primary coil is included in said resonant circuit. An output terminal is serially connected through the secondary coil to the high voltage lead of the charge-storing capacitor. During the incapacitation, the output terminal is operatively attached to at least a part of the living target. When the switch is closed, the resonant circuit stores initially substantially zero energy, and any gap if present between the output terminal and the living target undergoes electrical breakdown from energy stored in said charge-storing capacitor. After the electrical breakdown, the incapacitation current is provided substantially from the charge stored in the charge-storing capacitor.

According to an embodiment of the present invention there is provided an electronic circuit which provides an electrical incapacitation current to a living target. The circuit includes a high voltage power supply, a charge-storing capacitor connected by a high voltage lead to said high voltage power supply. The charge-storing capacitor stores a charge at high voltage as supplied by the high voltage power supply. The electronic circuit further includes: a resonant circuit, a switch closing the current path on the resonant circuit, a step-up transformer including a primary coil and a secondary coil. The primary coil is included in the resonant circuit. An output terminal is serially connected through the secondary coil to the high voltage lead of the charge-storing capacitor. During the incapacitation, the output terminal is operatively attached to at least a part of the living target. When the switch is closed, any gap if present between the output terminal and the living target undergoes electrical breakdown from energy circulating in the resonant circuit. After the electrical breakdown, the incapacitation current is provided substantially from the charge stored in said charge-storing capacitor. The electronic circuit includes a mechanism for actively controlling the incapacitation pulse(s).

The foregoing and/or other aspects will become apparent from the following detailed description when considered in conjunction with the accompanying drawing figures.

BRIEF DESCRIPTION OF THE DRAWINGS

The invention is herein described, by way of example only, with reference to the accompanying drawings, wherein.

DETAILED DESCRIPTION

Figure 1:
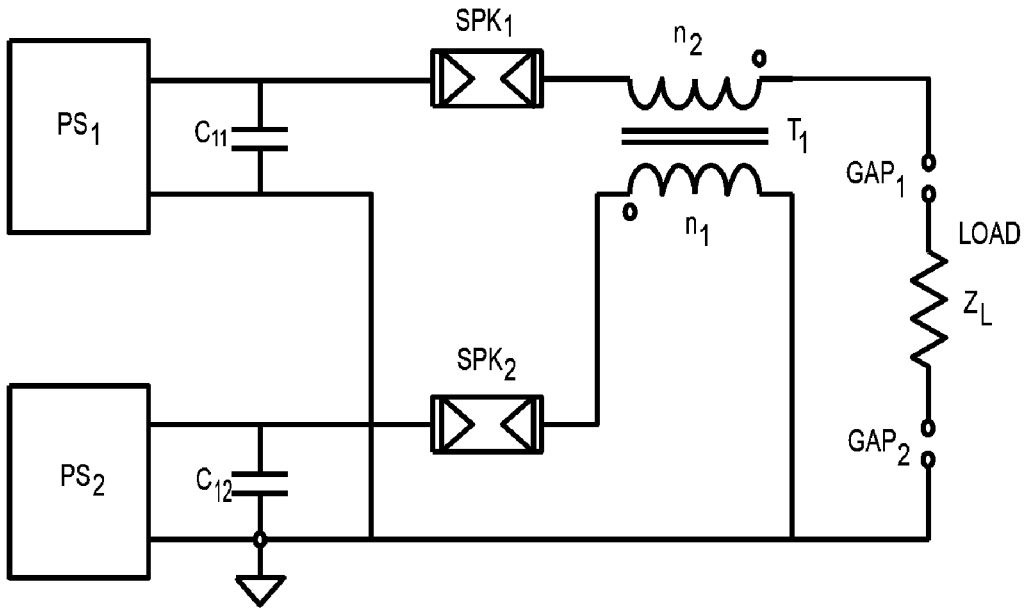
Fig. 1 Prior Art
FIG. 1 is a schematic circuit drawing according to the prior art.

Reference will now be made in detail to embodiments of the present invention, examples of which are illustrated in the accompanying drawings, wherein like reference numerals refer to the like elements throughout. The embodiments are described below to explain the present invention by referring to the figures.

Before explaining embodiments of the invention in detail, it is to be understood that the invention is not limited in its application to the details of design and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

By way of introduction, principal intentions of different aspects of the present invention are to (1) reduce the number of parts, complexity and weight of the circuitry required to incapacitate or immobilize the living target (2) provide control of the incapacitation current and/or charge.

Circuits according to some aspects of the present invention are more compact and of lighter weight and are more compatible with the volume and weight and weight requirements of a smaller caliber tetherless projectile. While the discussion herein is directed toward application to tetherless non-lethal weapons, principles according to different features of the present invention may be readily adapted for use with tethered non-lethal weapons.

Figure 2:
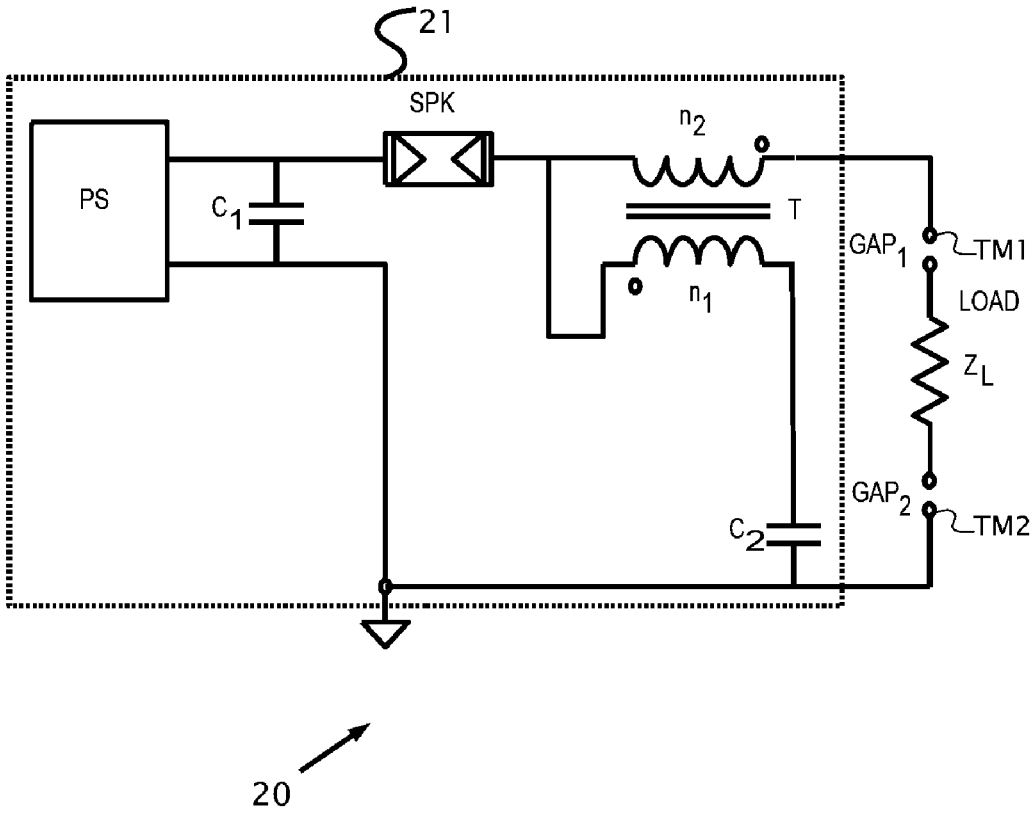
FIG. 2 is a simplified schematic diagram of a circuit, according to an embodiment of the present invention for incapacitating a target.
Figure 2A:
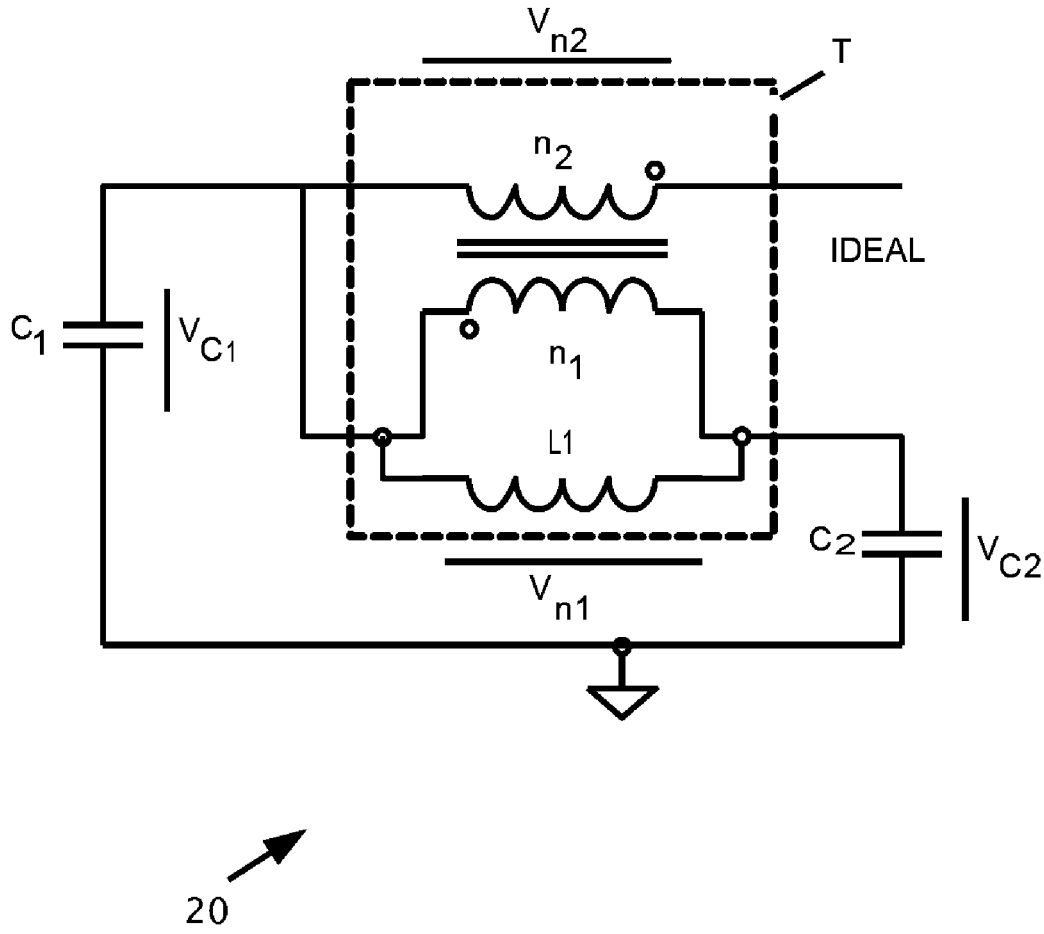
FIG. 2A illustrates schematically operation of the circuit of FIG. 2.

Referring now to the drawings, FIG. 2 illustrates a simplified schematic diagram of a circuit 20, according to an embodiment of the present invention for incapacitating a target. Circuit 20 includes a single high voltage power supply, PS, a single charge storing capacitor C1, a single spark gap SPK, high voltage transformer T, with primary n1 and secondary n2 with turns ratio of n1:n2 with n2 greater than n1. The output load includes the living target, represented by the electrical load $Z_L$. Output terminals TM1 and TM2 are connected to secondary n2 and ground respectively. Gaps or lack of galvanic contact between output terminals TM1, TM2 and the target if present are shown as GAP1, GAP2 respectively. Circuit 20 also includes a resonant capacitor, C2, which is initially void of electrical charge and intended to form a resonant circuit when connected in parallel with the charged C1 through primary n1 of transformer T. Circuit 21 known herein as composite pulse generating circuitry 21 includes power supply PS, single charge-storing capacitor C1, single spark gap SPK, high voltage transformer, T, and capacitor C2 (excluding load $Z_L$ and possible gaps GAP1 and GAPS thereto). Reference is now also made to FIG. 2A, which illustrates schematically operation of circuit 20 when the voltage $V_{C1}$ across C1 reaches the breakdown voltage of gap SPK. At breakdown across gap SPK, a resonant circuit is closed including C1, C2 and primary n1 of transformer T. The resonant frequency $f_r$ of this resonant circuit, is related to the values of the components according to:

$$f_r = \frac{1}{2\pi\sqrt{L1(C1C2/(C1+C2))}}, \tag{1}$$

where L1 is the inductance seen at the primary n1 of T.

The oscillation imposes a sinusoidal voltage $V_{n1}$ across primary n1 of transformer T, and consequently a high voltage $V_{n2}$ across n2 as per the turns ratio of windings, n1:n2 of transformer T. Typically, the value of the components are: L1=50 μH, C1=C2=0.1 μF and turns ratio n1:n2=1:35.

Figure 2B:
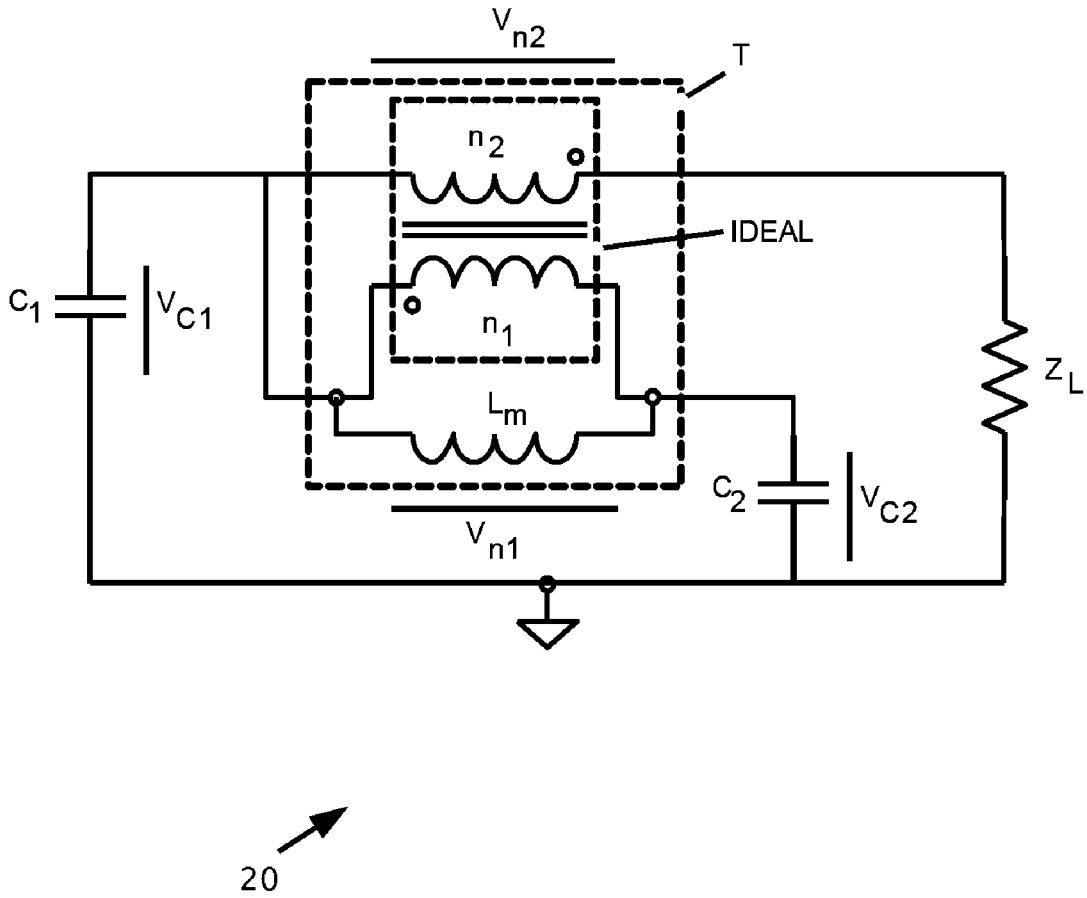
FIG. 2B illustrates operation of the circuit of FIG. 2 under the load of the living target.
Figure 3A:
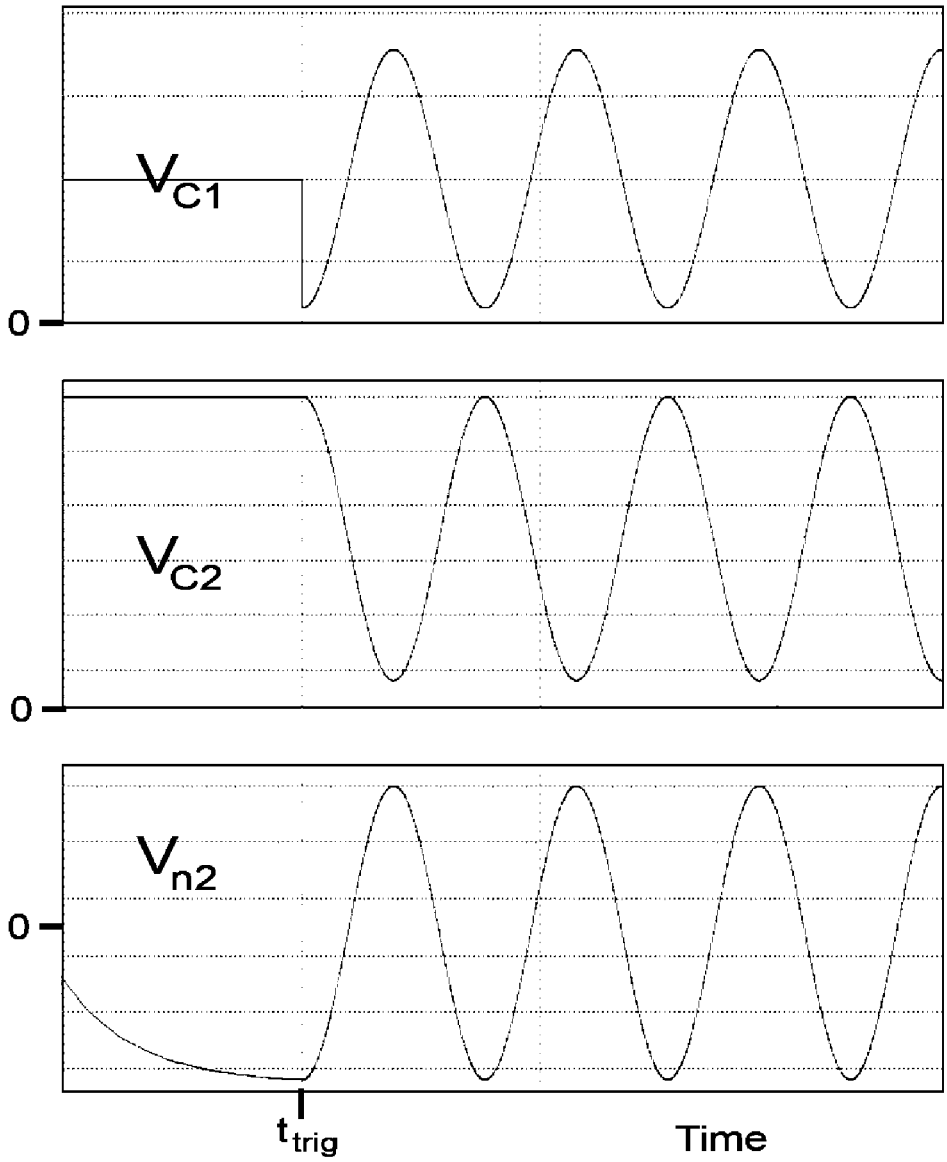
FIG. 3A illustrates graphically specific voltage waveforms during the operation of the circuit of FIG. 2.
Figure 3B:
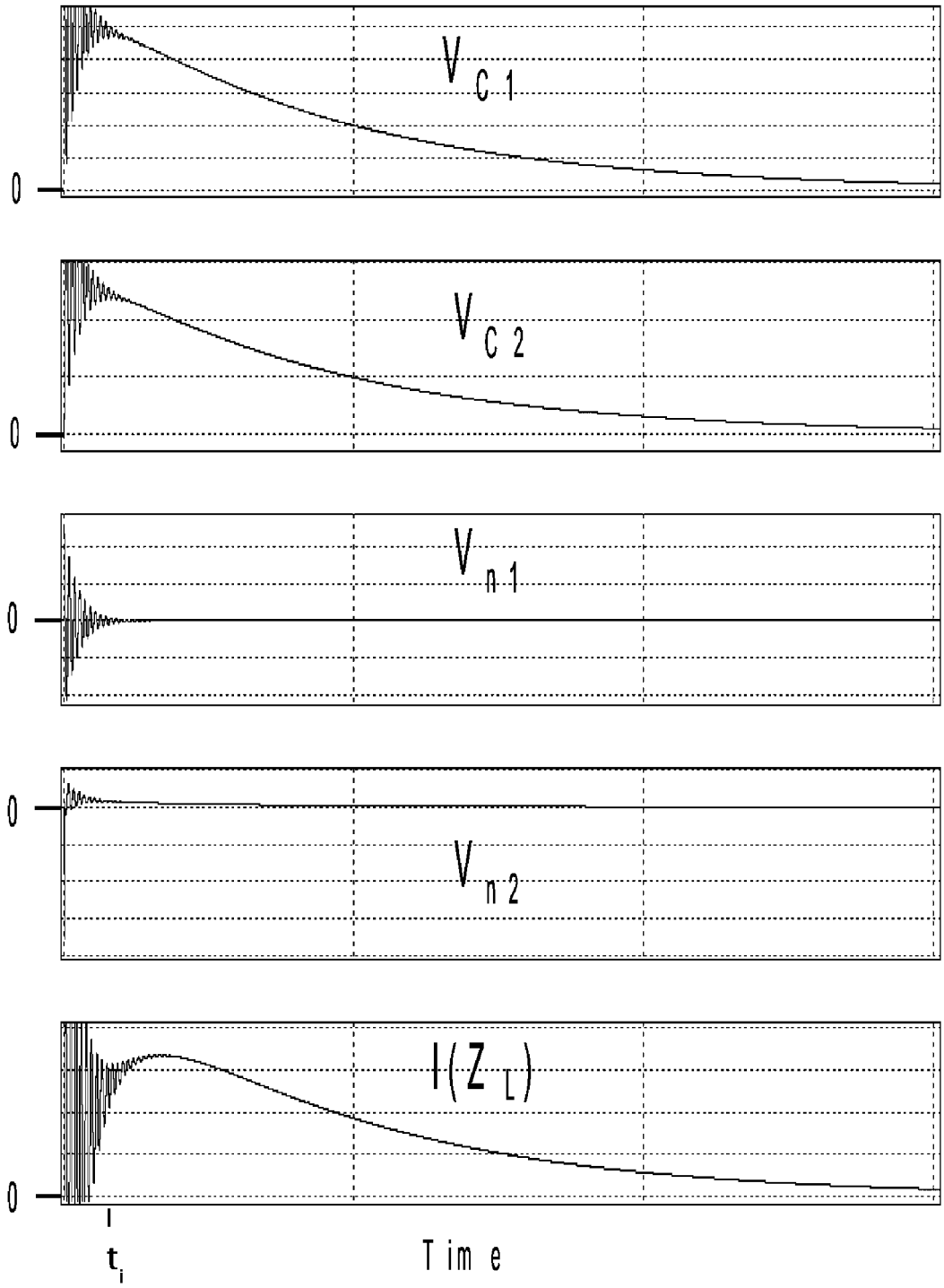
FIG. 3B which illustrates various resulting damped waveforms of voltage and current during the operation of the circuit of FIG. 2.

Reference is now also made to FIG. 3A, which illustrates graphically the resulting voltage waveforms (ordinate) against time (abscissa) in which $V_{C1}$ is the voltage across C1, $V_{C2}$ is the voltage across C2, $V_{n2}$ is the voltage across n2 and Ttrig is the time of voltage breakdown across SPK. Accordingly, a high voltage is generated across n2 that is determined by design (by setting the initial voltage $V_{C1}$ across C1 and the turns ratio of T, n1:n2 to be sufficiently large) to breakdown the gaps GAP1, GAP2. Reference is now also made to FIG. 2B which illustrates circuit 20 under load $Z_L$ of the target, once gaps GAP1, GAP2 break down generating a plasma and providing a conducting path between capacitors C1, C2 and the load $Z_L$. The loading of the circuit by $Z_L$ damps down the high voltage oscillation leaving a charge on capacitor C1 and capacitor C2 which are now connected in parallel via primary n1 of T. The energy left in capacitors C1, C2 is delivered to $Z_L$ via the secondary of transformer T and the conducting gaps GAP1, GAP2. Reference is now made to FIG. 3B which illustrates resulting damped waveforms of voltage $V_{C1}$ across capacitor C1, voltage $V_{C2}$ across capacitor C2, $V_{n1}$ across primary n1 of transformer T and voltage $V_{n2}$ across secondary n2 of transformer T during the loading of circuit 20 (FIG. 2B) after gaps GAP1 and GAP2 are broken down. $I(Z_L)$ is the incapacitating current through the target. High voltage resonant pulses begin at t=0 and the incapacitation current begins approximately at $t_i$.

During the operation of circuit 20, assuming an initial voltage across C1, $V_{C1o}$, the high voltage generated across the secondary of T, Vn2(t) is:

$$Vn2(t) = \frac{n2}{n1} V_{C1o} \cdot \sin(2\pi f_r). \tag{2}$$

The energy available for breaking down the gaps by the high voltage, Phv, is:

$$Phv = Pinitial - Pdc, \quad (3)$$

where $$Pinitial = \frac{C1 \cdot (V_{C1o})^2}{2} \quad (4)$$

and Pdc the energy stored in the capacitors after the decay of the high voltage oscillation:

$$Pdc = \frac{(V_{C1o})^2 \cdot C1}{2(C1 + C2)}. \quad (5)$$

Hence, by selecting C1, C2, $V_{C1o}$, and n2:n1, sufficient voltages and energies can be made available for gaps breakdown and for the incapacitation current.

Initial voltage $V_{C1o}$ on C1, in circuit 20, is determined by the breakdown voltage of SPK. The accuracy of the high voltage Vn2(t) will thus depend on the spread of the breakdown voltages of the spark gap.

Figure 4:
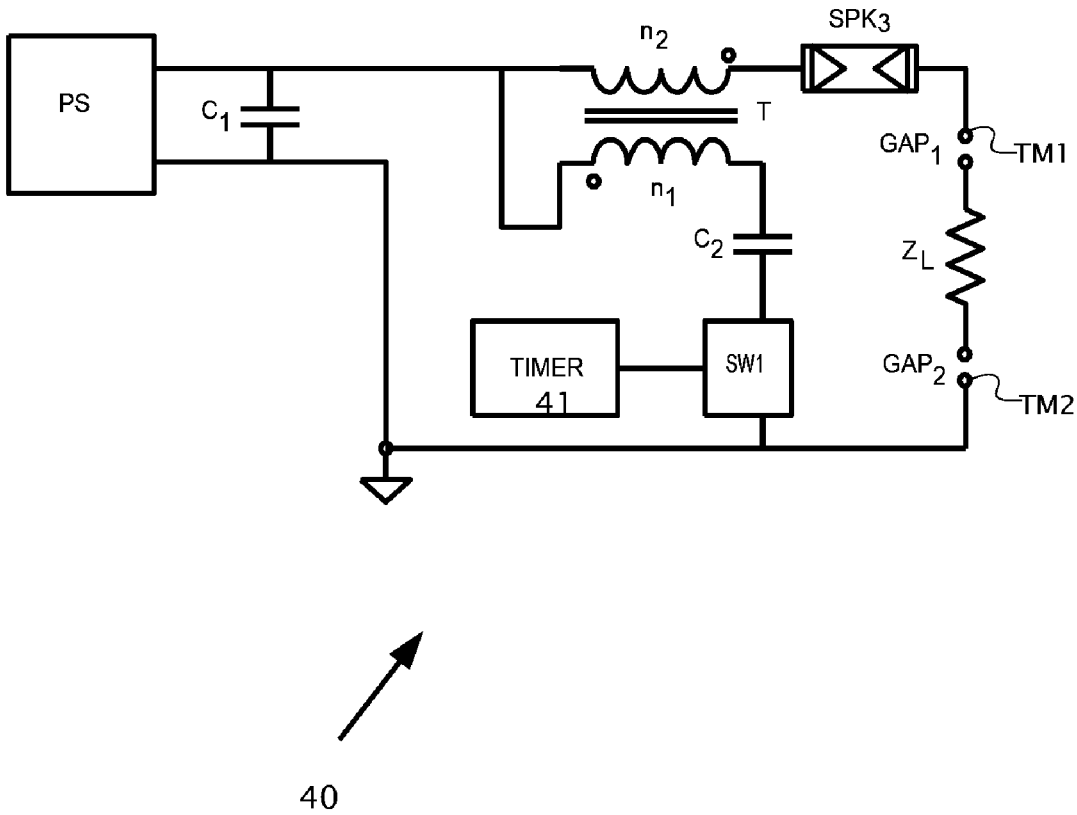
FIG. 4 is an alternative simplified schematic diagram, according to another embodiment of the present invention for incapacitating a target.

Reference is now made to FIG. 4, illustrating an alternative simplified schematic diagram of a circuit 40, according to another embodiment of the present invention for incapacitating a target. Circuit 40 improves the accuracy of the initial voltage $V_{C1o}$ across C1 and hence initial total energy Pinitial. Circuit 40 includes single high voltage power supply, PS, a single charge storing capacitor C1, high voltage transformer, T, with primary n1 and secondary n2 with turns ratio of n1:n2. The living target is represented by electrical load $Z_L$. Output terminals TM1 and TM2 are connected to secondary n2 and ground respectively. Gaps or lack of galvanic contact between output terminals TM1,TM2 and the living target if present are shown as GAP1, GAP2 respectively. Circuit 40 also includes resonant capacitor, C2, which is initially void of electrical charge and intended to form a resonant circuit when connected in parallel by a switch SW1 with charged capacitor C1 and primary coil n1 of transformer T. During the operation of circuit 40, switch SW1 is controlled for instance by a timer 41. Capacitor C1 is first charged to the required voltage and then switch SW1 controlled by timer 41 is closed periodically at a predetermined rate both to initiate high voltage generation and to deliver incapacitation current. Circuit 40 further includes a spark gap SPK3, according to a feature of the present invention. The function of spark gap SPK3 is to block undesired electrical conduction between C1 and the target, load $Z_L$ in a case when gaps GAP1 and/or GAP2 are both absent, e.g. the electrodes for instance of the non-lethal projectile, during operation both form a galvanic contact with the living target. In this case, it is not desirable to have capacitor C1 connected to the subject during the high voltage resonant pulses before time $t_i$ when the incapacitation current is supposed to begin. Spark gap SPK3 blocks conduction until the high voltage breaks down spark gap SPK3 at time $t_i$(FIG. 3B).

Figure 5:
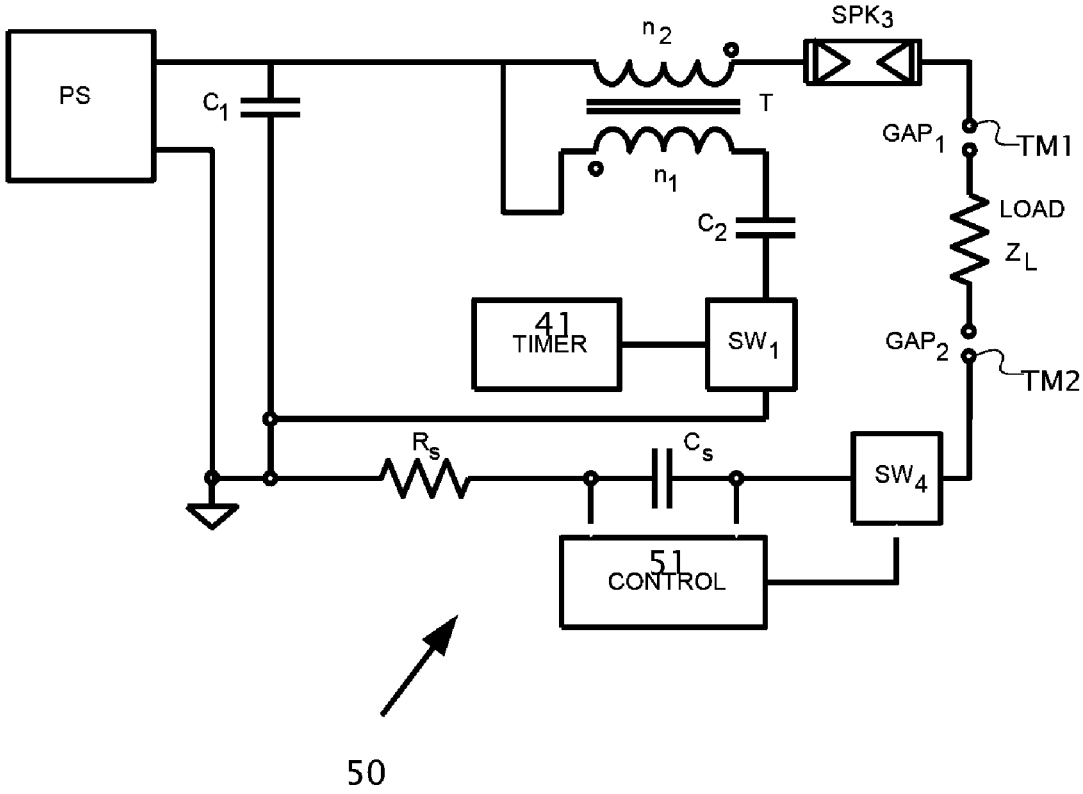
FIG. 5 is an alternative simplified schematic diagram, according to yet another embodiment of the present invention, for incapacitating a living target.

Reference is now made to FIG. 5, illustrating an alternative simplified schematic diagram of a circuit 50, for incapacitating a target according to another embodiment of the present invention. Circuit 50 includes single high voltage power supply, PS, single charge storing capacitor C1, high voltage transformer, T, with primary n1 and secondary n2 with turns ratio of n1:n2. The living target is represented by electrical load $Z_L$. Output terminals TM1 and TM2 are connected to secondary n2 and ground respectively. Gaps or lack of galvanic contact between output terminals TM1, TM2 and the target if present are shown as GAP1, GAP2 respectively. Circuit 50 also includes resonant capacitor, C2, which is initially void of electrical charge and forms a resonant circuit when connected in parallel by a switch SW1 with charged C1 and primary n1 of transformer T. During the operation of circuit 50, switch SW1 is controlled for instance by timer 41. Capacitor C1 is first charged to the required voltage and then switch SW1 controlled by timer 41 is closed to initiate high voltage generation and delivery of incapacitation current. Circuit 50 further includes spark gap SPK3 which functions as in circuit 40. A sense resistor Rs, disposed between load $Z_L$ and ground is used for current measurement through load $Z_L$ and a sense capacitor Cs is used to sense total charge per pulse delivered to the target. The voltage on sense capacitor Cs is a measure of the accumulative charge that passes through the target after time $t_i$. (FIG. 3B) Capacitor Cs is preferably discharged from pulse to pulse by, for example, adding a a resistor (not shown in FIG. 8) across capacitor Cs. Once the maximum permissible current or charge are reached, as sensed by a sensing/control circuit 51, control circuit 51 turns off a series switch SW4 to stop the incapacitation current.

Thus in circuit 50, a precise control is achievable for the total charge per pulse delivered to the target, and an upper limit to the maximum incapacitation current.

Figure 6:
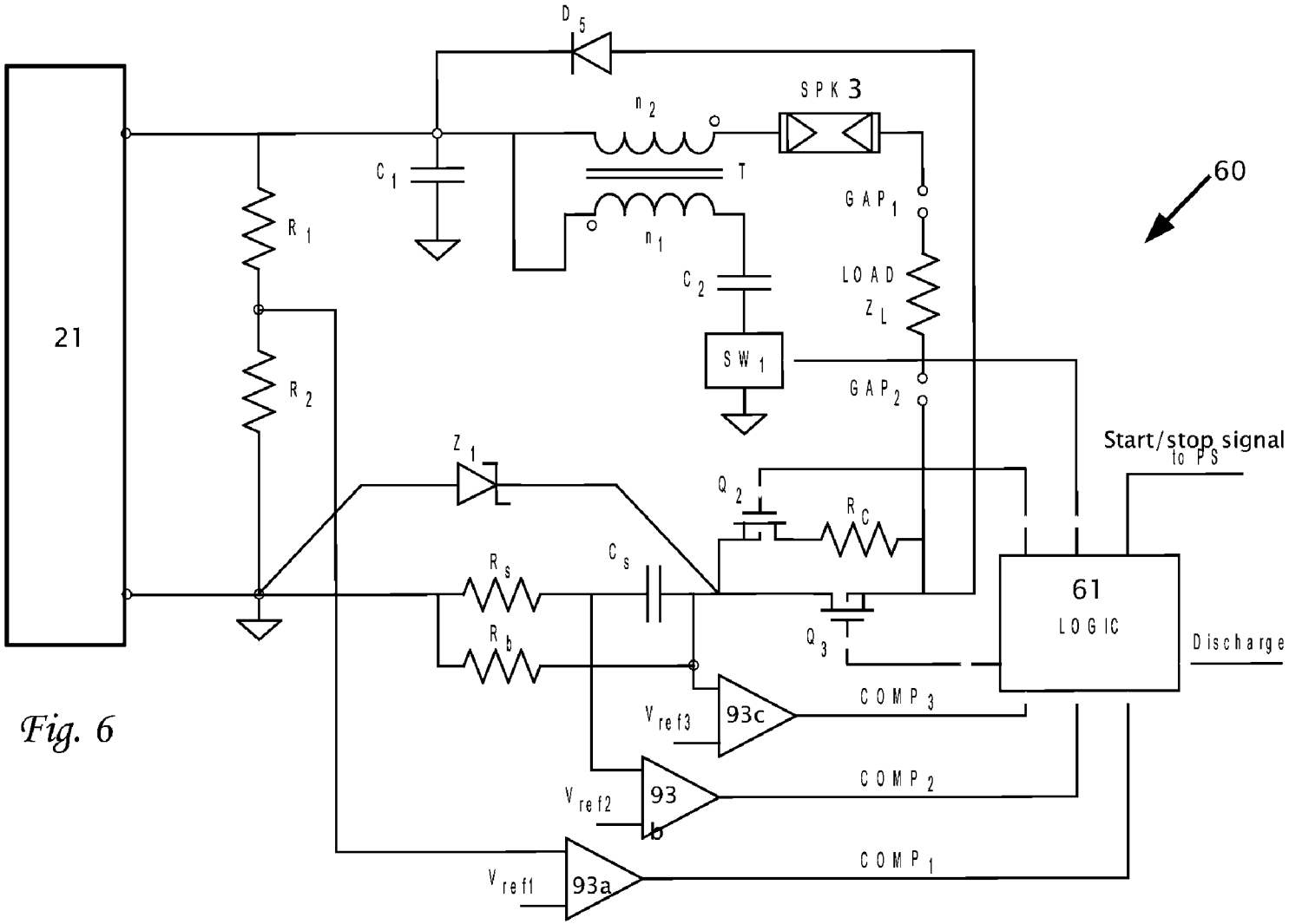
FIG. 6 is a schematic diagram showing more detail, according to another embodiment of the present invention, with some features similar to the circuit of FIG. 5.

Reference is now made to FIG. 6 which illustrates schematically in more detail a circuit 60 according to another embodiment of the present invention with some features similar to circuit 50. Circuit 60 includes single charge storing capacitor C1, high voltage transformer, T, with primary n1 and secondary n2 with turns ratio of n1:n2. The living target is represented by electrical load $Z_L$, and possible gaps GAP1, GAP2 are shown. Circuit 60 also includes resonant capacitor, C2, which is initially void of electrical charge and intended to form a resonant circuit when connected in parallel by a switch SW1 with charged C1 and primary coil n1 of transformer T. During the operation of circuit 60, switch SW1 is controlled for instance by a logical block 61. Capacitor C1 is first charged to the required voltage and then switch SW1 controlled by logical block 61 is closed to initiate high voltage generation and delivery of incapacitation current. Circuit 60 further includes spark gap SPK3 which functions as in circuit 40. Sense resistor Rs, between load $Z_L$ and ground is used for current measurement through load $Z_L$ and sense capacitor Cs is used to sense total charge per pulse delivered to the target. The voltage on sense capacitor Cs is a measure of the accumulative charge that passes through the subject from the incapacitation current starting time $t_i$. A discharge resistor Rb is connected across sensing capacitor Cs which discharges sensing capacitor between incapacitation signals. A protective element Zener diode Z1, is connected in parallel with series-connected sense resistor Rs and sense capacitor Cs limits the voltage at the sense points during the onset of the high voltage part of signal.

In circuit 60 the initial voltage across capacitor C1 is controlled by sensing the voltage at the junction between the series-connected sensing resistors R1, R2, connected in parallel to capacitor C1. One input to a comparator 93*a* is connected to the junction of resistors R1 and R2. The second input of comparator 93*a* is a voltage reference $V_{ref1}$. The digital output of comparator 93*a* is input to logical block 61. Comparators 93*b* and 93*c* have respective first inputs connected across sense capacitor Cs and second inputs connected respectively to voltage references Vref2 and Vref3. Outputs COMP2, COMP3 of comparators 93*b* and 93*c*, sense respectively maximum current limit and maximum charge limit and are both input to logical block 61. A current limiting resistor Rc is connected in series with load $Z_L$ and acts to limit current through load $Z_L$. The current limit is set by transistor Q2 connected (source to drain) in series with current limiting resistor Rc and transistor Q3 connected (source to drain) in parallel with series-connected current limiting resistor Rc and transistor Q2. Transistors Q2 and Q3 preferably act as switches and are controlled by gate voltages set by logical block 61. Logical block 61 controls the operation of circuit 60 by (i) sending a start/stop signal to the power supply PS which charges C1, (ii) starting the pulse sequence, by turning Q3 off with transistor Q2 on and thereby transferring the current through current limiting resistor Rc connected in series with the target (load $Z_L$), (iii) or by turning both Q2 and Q3 off to stop the current flow.

Freewheeling diode D5 connected between transistor Q3 and the high voltage end of capacitor C1 tends to limits any voltage spikes, when transistors Q2 and/or Q3 are turned off.

According to a feature of the present invention, multiple incapacitation pulses are provided at a rate, e.g. 20 pulses per second, to living target $Z_L$. During operation, the voltage required for breakdown of gaps GAP1 and GAP2 is variable because the length and resistance of gaps GAP1 and GAP2 are variable. When a galvanic connection exists to electrodes TM1, TM2 or when gaps GAP1 and GAP2 are relatively small, then the amount of energy required for breakdown of gaps GAP1 and GAP2 is comparatively small. Hence, the energy stored in C1 could be smaller. During the first pulse, relevant parameters may be measured such as, but not limited to, the residual voltage across C1 by sensing at the voltage divider resistors R1, R2 as illustrated in FIG. 6. The residual voltage of capacitor C1 is used by the logical block 61, along with possibly other data, to minimize the charge of C1 for the next incapacitating pulses. Hence, reducing the voltage across C1 "on-the-fly" allows for a savings of battery power and preferably improves the safety margin of the incapacitation.

Figure 7:
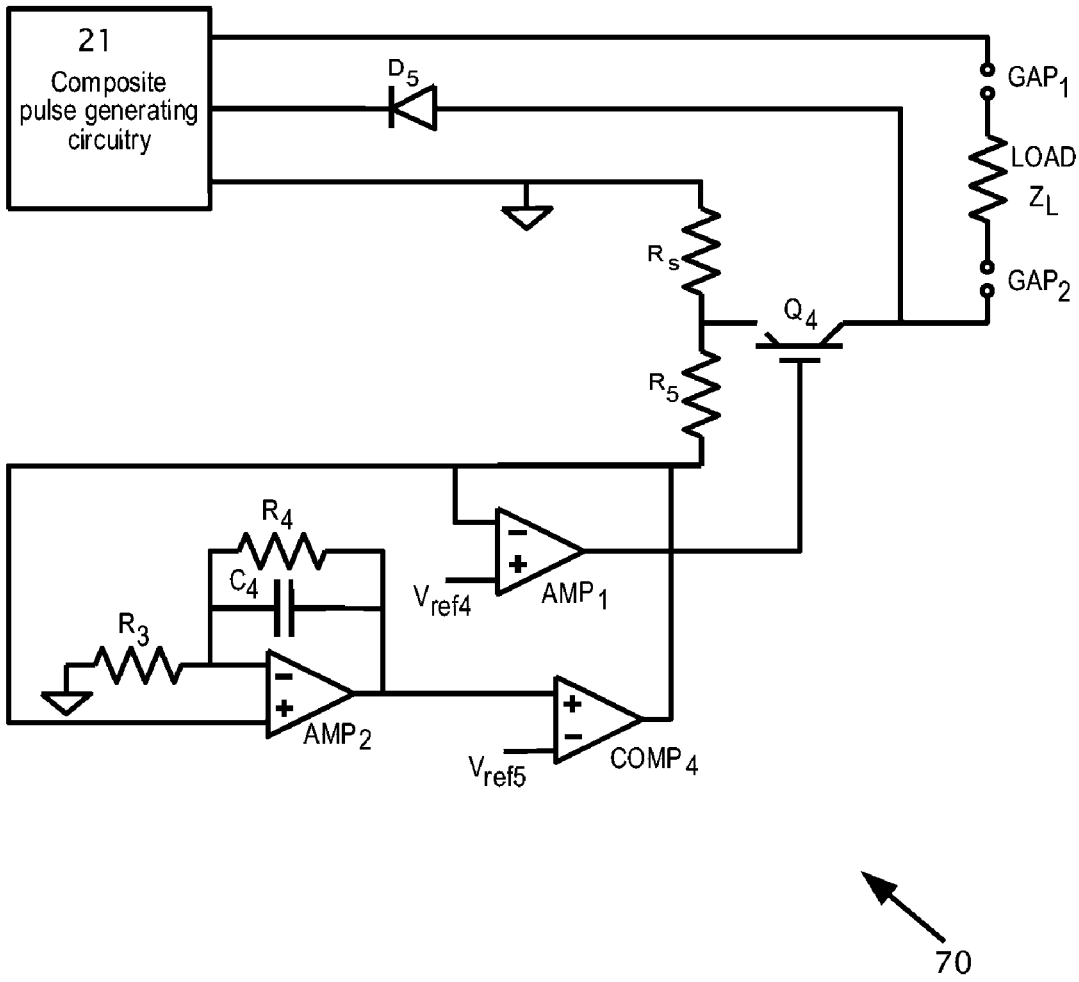
FIG. 7 is a simplified schematic diagram for controlling or shaping the current pulse for incapacitation, according to still another feature of the present invention.

Reference is now made to FIG. 7 which illustrates a circuit 70 for controlling or shaping the current pulse for incapacitation, according to another feature of the present invention. Composite pulse generating circuitry 21 (for example from circuit 20 of FIG. 2) includes power supply PS, single charge storing capacitor C1, single spark gap SPK, high voltage transformer, T, and capacitor C2. Control of the current pulse is accomplished by operational amplifier $AMP_1$ with output to gate of a transistor Q4 (e.g. power MOSFET or an IGBT) operating in the linear mode. The output current is sensed by sense resistor Rs. Resistor R5 is connected in series to sense resistor Rs. The other side of resistor R5 is connected to the inverting input of operational amplifier AMP1. The voltage across resistors Rs is compared to a voltage reference Vref4 connected at the non-inverting input of operational amplifier $AMP_1$. Thus, a closed loop configuration around amplifier AMP1 limits the current across load to Vref4/Rs. The voltage proportional to the current across Rs is integrated by an operational amplifier (AMP2) based integrator with capacitor C4 as integrating capacitor connected between the output of AMP2 and the inverting input of AMP2. Scaling resistor R3 is connected between the inverting input of amplifier AMP2 and ground. A bleeder resistor R4 is connected across capacitor C4. The output of operational amplifier AMP2 is connected to the non-inverting input of a comparator COMP4. A voltage reference Vref5 is connected to the inverting input of comparator COMP4. The output of comparator COMP4 is connected to the inverting input of operational amplifier AMP1. Once the total charge across capacitor C4, and hence via the target, reaches the predetermined value set by Vref5, comparator COMP4 will change state forcing Q4 to turn off. By this, the current as well as the total charge through the subject will be clamped to predetermined levels. As would be clear to a person trained in the art, other modes of operation are possible with this configuration. For example, by connecting the non-inverting input of integrator AMP2 to a voltage source that appears concurrently with the pulse, the integrator will function as a timer and the total current pulse length delivered to the subject will be fixed.

Figure 8:
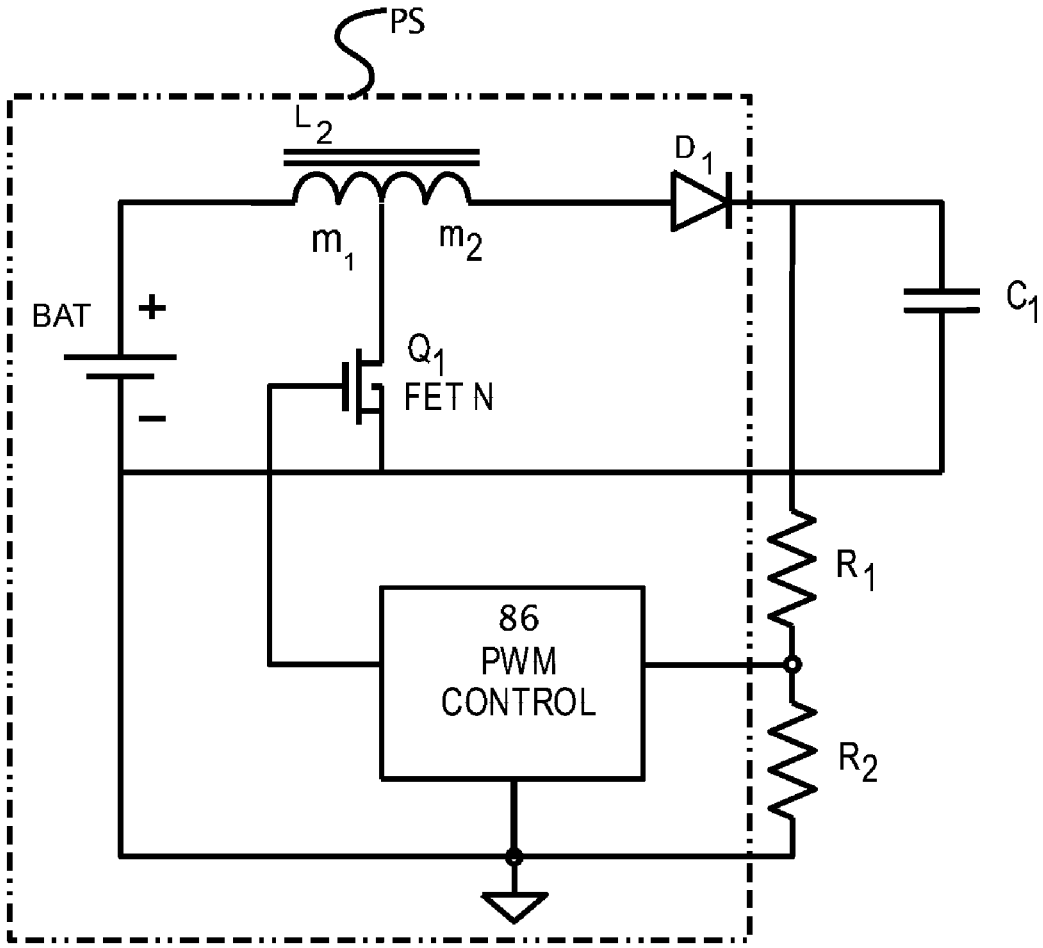
FIG. 8 is a simplified schematic diagram, according to a feature of the present invention, of a high voltage power supply as used in FIGS. 2, 4 and/or 5.
Figure 8A:
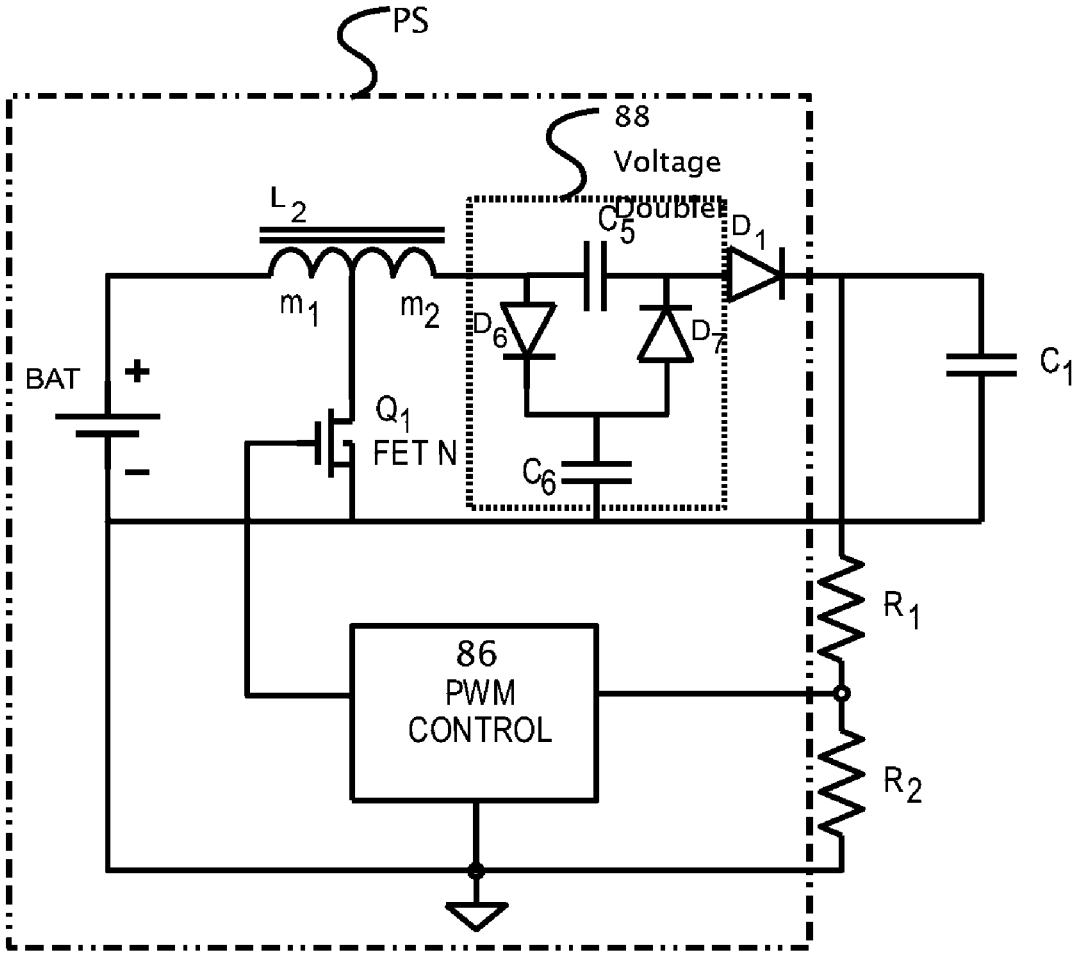
FIG. 8A is a variation of high-voltage power supply of FIG. 8 with the addition of a voltage doubler, according to another aspect of the present invention.

Reference is now made to FIG. 8, a simplified schematic diagram according to a feature of the present invention, of a high voltage power supply PS which is an alternative for high voltage power supply PS of FIGS. 2,4 and/or 5. High voltage power supply PS is a boost converter built around a tapped inductor L2 as opposed to using a transformer, e.g. transformer T in circuit 21. Boost converter circuit PS includes a primary energy source, e.g. battery BAT, connected at the positive terminal to tapped inductor L2. Inductor L2 is connected in series to the anode of a steering diode D1. The cathode of steering diode D1 is connected to single charging capacitor C1. Boost converter circuit 21B is driven by a pulse wave modulation (PWM) controller 86 that determines the 'on' and 'off' states of the power switch, e.g. N type FET Q1. As would be clear to a person trained in the art, the tapped inductor boost converter is useful for generating a high output voltage using the PWM technology with a practical duty ratio D defined as the ratio between the 'on' state of the transistor Q1 and the switching period. By connecting Q1 to the tap of L2 an extra voltage is obtained. Even so, if the voltage gain ratio may be too low for instance when the primary voltage source is a battery such as a lithium ion battery with an output voltage in range of 3V, then a voltage multiplier may be added. Reference is now made to FIG. 8A, which is a variation of high-voltage power supply PS with a voltage doubler 88. The elements of voltage doubler 88 include capacitors C5 and C6, diodes D6 and D7. Capacitor C6 is charged by circuit when FET Q1 is in the 'off' state. During the 'on' state of FET Q1, the voltage across capacitor C5 is charged by capacitor C6 and by the negative voltage at end of inductor L2. The magnitude of this negative voltage Vneg is:

$$Vneg = \frac{m1 + m2}{m1} Vbat, \tag{6}$$

where m1 and m2 are the number of turns of the tapped inductor L2, and Vbat is the battery voltage. Consequently, the voltage delivered to capacitor C1 is the sum of the output of the boost converter plus the voltage across capacitor C5 which is even higher than the voltage across C6.

Figure 9:
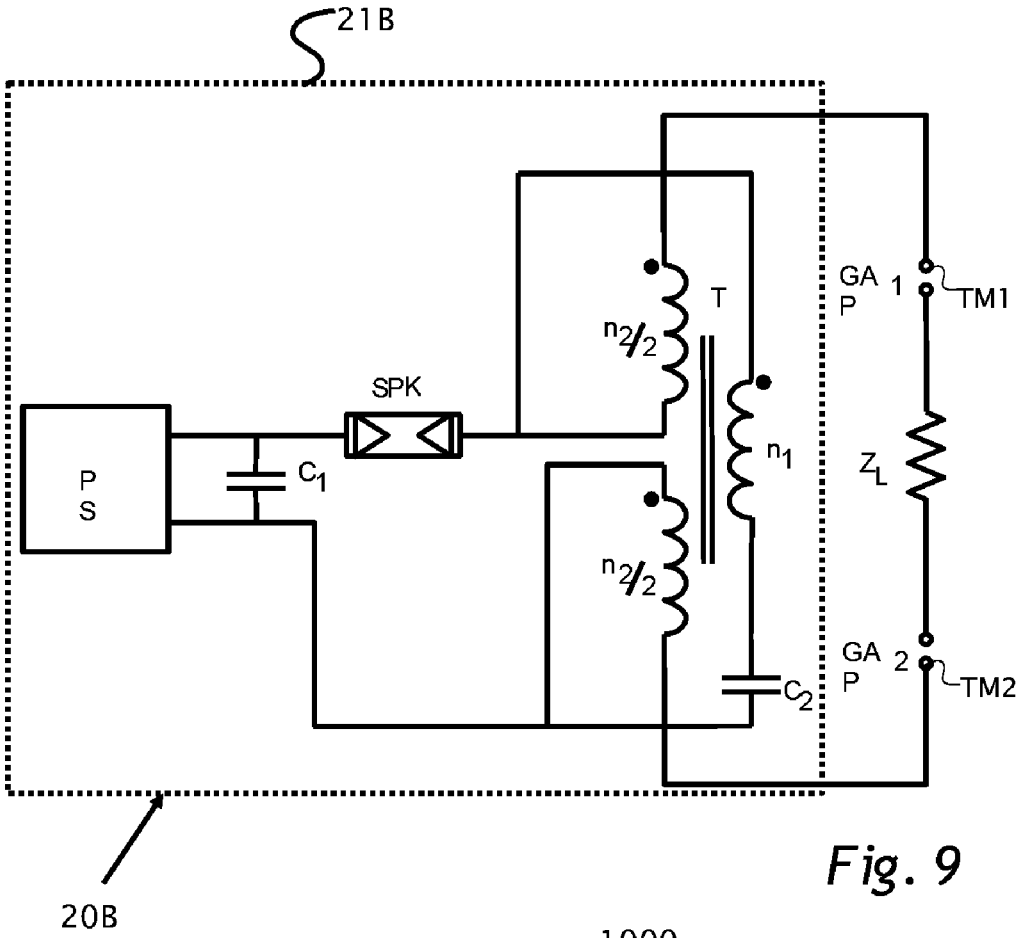
FIG. 9 is a simplified schematic diagram, according to still another embodiment of the present invention, for incapacitating a living target.

Reference is now made to FIG. 9, which illustrates an alternative circuit 20B, including a circuit 21B for providing composite pulse generation, according to an embodiment of the present invention. Circuit 21B includes single high voltage power supply, PS, single charge storing capacitor C1, single spark gap SPK, high voltage transformer T, with primary n1 and two secondary coils n2/2 each with a turns ratio of n1:n2/2. In circuit 20B, the living target is represented by electrical load $Z_L$. Output terminals TM1 and TM2 are connected to secondary n2 and ground respectively. Gaps or lack of galvanic contact between output terminals TM1, TM2 and the living target if present are shown as GAP1, GAP2 respectively. Circuit 20B also includes resonant capacitor, C2, which is initially void of electrical charge and intended to form a resonant circuit when connected in parallel with the charged C1 and primary n1 of transformer T. In circuit 21B load $Z_L$ is connected at each output terminal to both the secondary coils n2/2. The advantage of this configuration is the reduction of the voltage on each secondary winding n2/2 and between each end of the secondary n2/2 and primary n1. A more economical design of transformer T results, in some embodiments of the present invention by reducing the voltage stresses that may cause internal breakdown.

Figure 10:
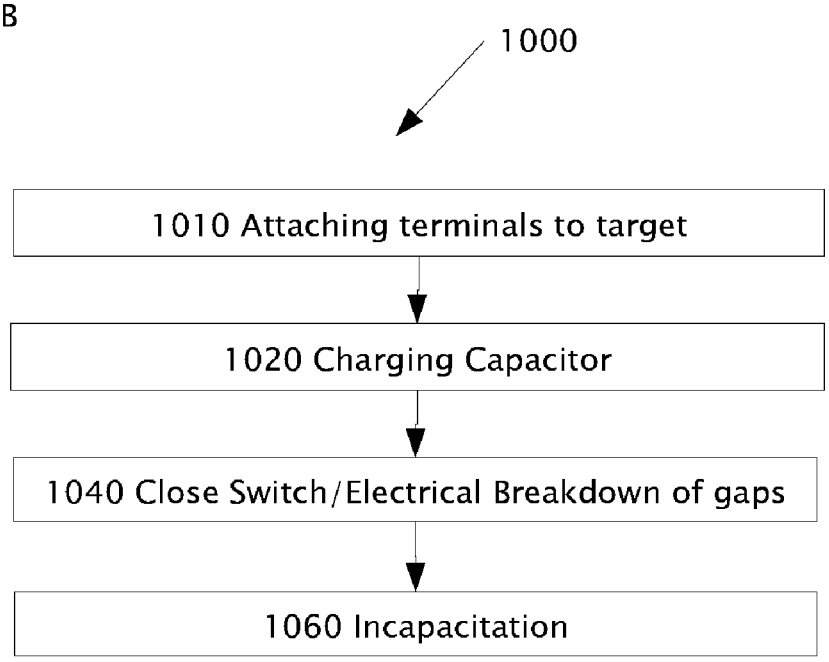
FIG. 10 is a simplified flow diagram, according to an embodiment of the present invention.

Referring now to FIG. 10, there is illustrated a method 1000 of incapacitating a target, according to an embodiment of the present invention. Method 1000 includes various operations, including: operatively attaching (operation 1010) an output terminal to a target; charging (operation 1020) capacitor C1 to a predetermined level; closing switch SPK when capacitor C1 is charged to the predetermined level and thereby electrically breaking down (operation 1030) a gap between output terminals (TM1,TM2) and the living target from energy stored in the charge storing capacitor; and incapacitating (operation 1040) the target with the charge stored in charge-storing capacitor C1.

While the invention has been described with respect to a select number of embodiments, it is to be appreciated that many variations, modifications and other applications of the invention may be made. Indeed, it is be appreciated that changes may be made in these described embodiments without departing from the principles and spirit of the invention, the scope of which is defined in the claims and their equivalents.

The invention claimed is:

1. A circuit that delivers an incapacitation current to a living target, the circuit comprising:

a high voltage power supply;

a charge-storing capacitor connected by a high voltage lead thereof to said high voltage power supply, said charge-storing capacitor storing a high voltage charge as supplied by said high voltage power supply;

a switch;

a step-up transformer including a primary coil and a secondary coil;

a resonant capacitor connected in parallel with said charge-storing capacitor through said primary coil; and an output terminal connected in series to said high voltage lead of said charge-storing capacitor through said secondary coil, wherein said primary coil is connected in parallel with said charge-storing capacitor through said switch and said resonant capacitor, wherein, during delivery of said current, said output terminal is operatively attached to said living target; and wherein, when said switch is closed, any gap between said output terminal and said target undergoes electrical breakdown from energy stored in said charge-storing capacitor, and after said electrical breakdown, said incapacitation current is provided substantially from said charge stored in said charge-storing capacitor.

2. The electronic circuit according to claim 1, wherein, when said switch is closed, an electrical resonance starts in a resonance path including said primary coil, said resonant capacitor and said charge-storing capacitor through said switch, wherein voltage peaks of said resonance as induced in said secondary coil contribute to said electrical breakdown.

3. The electronic circuit according to claim 1, further comprising a spark gap operatively connected in series with said output terminal, wherein said spark gap undergoes electrical breakdown from said energy stored in said charge-storing capacitor, whereby said spark gap provides an electrical breakdown operation even when there is no gap between said output terminal and said living target.

4. The electronic circuit according to claim 1, wherein said switch is closed when said charge-storing capacitor is charged to a specified level.

5. The electronic circuit according to claim 1, wherein said switch is a spark gap which breaks down at a specified voltage.

6. The electronic circuit according to claim 1, wherein said switch is controlled by a timer that closes said switch at a predetermined rate.

7. The electronic circuit according to claim 1, wherein said high voltage power supply includes:

(i) a battery;

(ii) a tapped inductor with a first lead connected to said battery and a second lead operatively connected to said high voltage lead of said charge-storing capacitor; and (iii) a boost converter connected to a tapped lead of said tapped inductor with a high voltage output operatively connected to said charge-storing capacitor.

8. The electronic circuit according to claim 1, further comprising:

a second secondary coil of said transformer; and a second output terminal operatively attached to at least a part of said living target; wherein said second secondary coil electrical connects said second output terminal to a low voltage lead of said charge-storing capacitor.

9. A circuit that delivers an incapacitation pulse to a living target, the circuit comprising:

a high voltage power supply;

a charge-storing capacitor connected by a high voltage lead thereof to said high voltage power supply, said charge-storing capacitor storing a high voltage charge as supplied by said high voltage power supply;

a switch;

a step-up transformer including a primary coil and a secondary coil;

a resonant capacitor connected in series with said primary coil; said primary coil and said resonant capacitor are connected in parallel to said charge-storing capacitor through said switch;

an output terminal connected in series to said high voltage lead of said charge-storing capacitor through said secondary coil; and a mechanism that actively controls the incapacitation pulse, wherein during said delivery, said output terminal is operatively attached to the target, and wherein, when said switch is closed, any gap between said output terminal and said target undergoes electrical breakdown from energy stored in said charge-storing capacitor, and after said electrical breakdown, the incapacitation pulse is provided substantially from said charge stored in said charge-storing capacitor.

10. The electronic circuit according to claim 9, wherein said mechanism includes:

a sense resistor operatively connected in series with the living target; and an operational amplifier with an input connected to said sense resistor and an output operatively connected to said target, and wherein said sense resistor and said operational amplifier provide said active control of the incapacitation pulse in a closed loop.

11. The electronic circuit according to claim 9, wherein said mechanism includes:

a sense resistor operatively connected in series with the living target; and a control circuit with an input from said sense resistor, said input proportional to incapacitation current of the at least one incapacitation pulse.

12. The electronic circuit according to claim 9, wherein said mechanism includes:

a sense capacitor operatively connected in series with the living target; and a control circuit including an input from said sense capacitor proportional to the charge of the incapacitation pulse delivered to said target.

13. A method of incapacitating a living target, the method comprising:

operatively attaching an output terminal to a target, said output terminal being part of a circuit that includes a high voltage power supply, a charge-storing capacitor connected by a high voltage lead thereof to said high voltage power supply, said charge-storing capacitor storing a high voltage charge as supplied by said high voltage power supply, a switch, a step-up transformer including a primary coil and a secondary coil, a resonant circuit including said primary coil connected in parallel with said charge-storing capacitor through said switch, and an output terminal operatively connected through said secondary coil to said high voltage lead of said charge-storing capacitor;

charging said capacitor to a specified level;

closing said switch when said capacitor is charged to said specified level and thereby electrical breaking down a gap between said output terminal and the target with energy stored in said charge storing capacitor; and delivering an incapacitating current to the target from said charge stored in said charge-storing capacitor.

14. The method according to claim 13, wherein, just prior to closing said switch, said resonant circuit stores substantially zero energy.

15. The method according to claim 13, further comprising upon said closing said switch, starting an electrical resonance in said resonant circuit including said primary coil, a resonant capacitor and said charge-storing capacitor through said switch, and thereby inducing resonance peaks in said secondary coil which contribute to said electrical breakdown, wherein said resonant capacitor is connected in parallel with said charge-storing capacitor through said primary coil.

16. The method according to claim 13, wherein said incapacitation current is provided in a series of pulses, the method further comprising:

measuring a residual voltage on said charge-storing capacitor; and adjusting said predetermined level for at least one subsequent pulse of said pulses based on a measured residual voltage.

17. A circuit that provides an electrical incapacitation current to a living target, the circuit comprising:

a high voltage power supply;

a charge-storing capacitor connected by a high voltage lead thereof to said high voltage power supply, said charge-storing capacitor storing a high voltage charge as supplied by said high voltage power supply;

a resonant circuit;

a switch connecting said resonant circuit to said charge storing capacitor;

a step-up transformer including a primary coil and a secondary coil, said primary coil being in said resonant circuit; and an output terminal connected in series to said high voltage lead of said charge-storing capacitor through said secondary coil, wherein, during a provision of said incapacitation current, said output terminal is operatively attached to said target, and wherein, when said switch is closed, said resonant circuit stores initially substantially zero energy, and any gap between said output terminal and the target undergoes electrical breakdown from energy stored in said charge-storing capacitor, and after said electrical breakdown, said incapacitation current is provided substantially from said charge stored in said charge-storing capacitor.

18. A circuit that generates and delivers a current to a target, the circuit comprising:

a high voltage power supply;

a charge-storing capacitor connected by a high voltage lead thereof to said high voltage power supply, said charge-storing capacitor storing a high voltage charge supplied by said high voltage power supply;

a resonant circuit having a current path;

a switch closing the current path;

a step-up transformer including a primary coil and a secondary coil, said primary coil being in said resonant circuit;

an output terminal connected to said high voltage lead of said charge-storing capacitor through said secondary coil; and a mechanism that a controls delivery of the incapacitation pulse, wherein, during a delivery of the current, said output terminal is operatively attached to said target, and wherein, when said switch is closed, any gap between said output terminal and said target is closed by electrically conducting plasmas resulting from energy circulating in said resonant circuit, and after said electrical breakdown, said current is provided substantially from said charge stored in said charge-storing capacitor.

* * * * *